US005851305A

United States Patent [19]

Yamada et al.

[11] Patent Number: 5,851,305

[45] Date of Patent: Dec. 22, 1998

[54] WASHING APPARATUS AND WASHING METHOD

[75] Inventors: Yousuke Yamada; Yoshio Fujioka, both of Funabashi; Ryuichi Isono, Tokyo; Nobuo Takahashi, Tokyo; Akio Hayashi, Tokyo; Koichi Ogawa, Osaka; Norio Watanabe, Tokyo; Yutaka Satoh, Kanagawa, all of Japan

[73] Assignees: Zenken Co., Ltd., Funabashi; Kinzolu Kako Gijutsu Kenkyusho Co., Ltd., Tokyo; Kuraray Co., Ltd., Okayama, all of Japan

[21] Appl. No.: 703,954

[22] Filed: Aug. 28, 1996

[30] Foreign Application Priority Data

Aug. 31, 1995 [JP] Japan ..... 7-248693

[51] Int. Cl.[6] ..... C23G 1/24; C23G 1/26; C23G 1/36

[52] U.S. Cl. ..... 134/10; 134/2; 134/19; 134/254; 134/26; 134/40

[58] Field of Search ..... 134/2, 10, 19, 134/22.19, 25.1, 25.4, 26, 40, 61, 84, 91, 109, 110

[56] References Cited

U.S. PATENT DOCUMENTS 5,146,938 9/1992 Lutener et al. ..... 134/40
5,213,624 5/1993 Williams ..... 134/40
5,300,154 4/1994 Ferber et al. ..... 134/10
5,389,156 2/1995 Mehta et al. ..... 134/34
5,393,451 2/1995 Koetzle ..... 134/39
5,425,814 6/1995 Krajicek et al. ..... 134/39
5,464,477 11/1995 Awad ..... 134/1
5,503,681 4/1996 Inada et al. ..... 134/1

*Primary Examiner*—Jan Ludlow
*Attorney, Agent, or Firm*—Oblon, Spivak, McClelland, Maier & Neustadt, P.C.

[57] ABSTRACT

A washing apparatus includes a washing bath in which articles to be cleaned are washed. The washing bath contains a detergent of a kind containing a nonion surface active agent and a terpene-based solvent as principal components thereof. The articles to be cleaned are, after having been washed in the washing bath, immersed in a rinsing bath containing a rinsing water. The rinsing bath is provided with a recirculating passage extending from a portion of the rinsing bath back to another portion of the rinsing bath, a precision filter disposed on the recirculating passage and having a micro-porous membrane having an average pore size not smaller than 0.01 μm, but not greater than 0.2 μm, and an adsorbent filter containing a mass of activated carbon for substantially purifying the rinsing water which has been passed through the precision filter. The articles to be cleaned are first washed with the detergent of the specified kind and then rinsed within the rinsing bath. The rinsing water used for the articles is, after having been filtered through the micro-porous membrane, substantially purified by the adsorbent filter containing a mass of activated carbon.

4 Claims, 2 Drawing Sheets

WASHING APPARATUS AND WASHING METHOD

BACKGROUND OF THE INVENTION 1. (Field of the Invention)

The present invention relates to a method of and an apparatus for washing articles to be cleaned such as, for example, machine component parts, which have oil-based contaminants sticking thereto.

2. (Description of the Prior Art)

An effective washing method of washing oil-contaminated articles has long well-known in the art, in which the oil-contaminated articles are washed by the use of a water-based detergent, then rinsed with a rinsing water, and finally dried. The detergent used in the practice of this known washing method is not only excellent in its detergent action, but is also less hazardous to human bodies during handling thereof in contrast to a hydrocarbon detergent such as trichloroethylene.

However, it has often been observed that during rinsing with the rinsing water, the rinsing water is susceptible to contamination with the detergent which has been stuck to the articles to be cleaned during the washing thereof. Accordingly, in order to keep the rinsing water clean and effective at all times, a fresh quantity of rinsing water is required to be supplemented and the contaminated rinsing water is disposed of as a waste water. Since this waste water cannot be drained directly to outside of plants where the oil-contaminated articles are washed, the waste water must be processed in any way whatsoever to remove contaminants before it can be drained outside as a substantially purified water, and this necessitates the existing washing system to be equipped with an anti-pollution disposal equipment. Addition of the anti-pollution disposal equipment does not only increase the cost incurred in cleaning the oil-contaminated articles, but also render the washing system as a whole to be complicated. Accordingly, most plants generally have no way other than to have the waste water disposed of by waste disposal industries.

Also, since the articles to be cleaned is generally washed with a water-based detergent, the articles are susceptible to rusting. For example, zinc-plated steel plates, surfaces of which have been chromated, are especially prone to rusting since chromated surface films are apt to be removed during the washing.

Accordingly, the present invention has for its object to provide an improved washing method of and an improved apparatus for washing oil-contaminated articles, wherein while the rinsing water is processed to allow it to have a satisfactory detergent power at all times, the rinsing water can be repeatedly and continuously utilized without being drained to outside of a washing plant.

Another important object of the present invention is to provide an improved method of and an improved apparatus both effective to minimize generation of rust after the oil-contaminated articles have been washed.

SUMMARY OF THE INVENTION

In order to accomplish these and other objects, the present invention provides a washing method comprising the steps of washing articles to be cleaned with the use of a detergent containing a nonion surface active agent and a terpene-based solvent as principal components thereof and rinsing the articles with a rinsing water, wherein the rinsing water used for the rinsing of the articles is, after having been filtered through a micro-porous membrane having an average pore size not smaller than 0.01 μm, but not greater than 0.2 μm, substantially purified by activated carbon.

The present invention also provides a washing apparatus which comprises a washing bath in which the articles to be cleaned are washed, said washing bath containing a detergent of a kind containing a nonion surface active agent and a terpene-based solvent as principal components thereof, a rinsing bath containing a rinsing water and in which the articles removed from the washing bath are rinsed, a recirculating passage extending from a portion of the rinsing bath back to another portion of the rinsing bath, a precision filter disposed on the recirculating passage and having a micro-porous membrane having an average pore size not smaller than 0.01 μm, but not greater than 0.2 μm, and an adsorbent filter containing a mass of activated carbon for substantially purifying the rinsing water which has been passed through the precision filter.

For the nonion surface active agent which is one of the principal components of the detergent employed in the practice of the present invention, a poly-functional alcohol derivative having mainly an OH group and an ether group may be employed. The terpene-based solvent which is the other principal components of the detergent may be, for example, a dipentene oil, a turpentine oil, a pinene oil, a pine oil, a camphor oil, a lemon oil, a tenpin oil or the like. The detergent containing the nonion surface active agent and the terpene-based solvent as the principal components thereof is well known in the art and is currently commercially sold under a trade name, "Water-soluble Detergent KZ-4000" available from Kabushiki Kaisha Kinzoku Kako Gijutsu Kenkyusho of Japan.

The rinsing water contained in the rinsing bath may contain the detergent, which has been carried over together with the articles in the form of colloidal micelles sticking to the articles, oil-based contaminants, oil-based contaminants which have been emulsified by the detergent, and finely divided particles (SS components) such as, for example, ground chips (all of which are hereinafter referred to as "foreign matter"). Therefore, those foreign matter must necessarily be separated and removed from the rinsing water.

In order to efficiently and effectively separate and remove from the rinsing water those foreign matter referred to above, the micro-porous membrane employed in the precision filter has an average pore size within the range of 0.01 to 0.2 μm. If the average pore size of the micro-porous membrane is smaller than 0.01 μm, the micro-porous membrane is susceptible to clogging accompanied by reduction in flux to such an extent that the efficiency of filtration performed by the precision filter will decrease considerably. On the other hand, if the average pore size referred to above is greater than 0.2 μm, assured removal of the foreign matter by the precision filter will not be achieved. It is to be noted that the average pore size referred to above is represented by the particle size of 90% of known standard substances such as, for example, particles of colloidal silica, emulsion or latex which can, when those known standard substances are allowed to flow through the micro-porous membrane, be removed by the micro-porous membrane. Preferably, the micro-porous membrane employed in the practice of the present invention preferably has a pore size as uniform as possible and may be employed in the form of a plane micro-porous membrane, a tubular micro-porous membrane or a hollow fiber membrane. Of them, the use of the hollow fiber membrane is more preferred for the micro-porous membrane used in the precision filter.

The micro-porous membrane that can be employed in the practice of the present invention may be made of cellulose acetate, polyacrylonitrile, polymethacrylate esters, polyamides, polyesters, polyvinyl alcohol, polyolefines, or polysulfones by the use of any known spinning process (which may be a wet method, a dry method or a melting method) or may be in the form of an inorganic micro-porous membrane, ceramic, for example. Where the micro-porous membrane made of the polymer is used for the micro-porous membrane, such polymer may be copolymerized with 30 mol %, or 20 mol % as the case may be, or less of another material, or may be blended with 30 mol %, or 20 mol % as the case may be, or less of another material. In particular, the micro-porous membrane of polyvinyl alcohol is conveniently employed since it is stable in a wide range of pH values and exhibits a high resistance to an organic solvent. Considering that the rinsing water is heated in the practice of the present invention, the micro-porous membrane should have a sufficient heat resistance.

Because of the reasons discussed above, of the various micro-porous membranes of polyvinyl alcohol system, the micro-porous membrane made of polyvinyl alcohol cross-linked with a poly-functional aldehyde such as glutaraldehyde, or the micro-porous membrane made of polyvinyl alcohol cross-linked with a mono aldehyde such as formaldehyde and a poly-functional aldehyde such as glutaraldehyde, both of which has a sufficient heat resistance and an excellent physical property, may be conveniently employed in the practice of the present invention. Examples of them are disclosed in, for example, the Japanese Laid-open (unexamined) Patent Applications No. 52-21420 and No. 54-117380, published in 1977 and 1979, respectively.

Where the hollow fiber membrane is employed for the micro-porous membrane, the hollow fibers forming the hollow fiber membrane should have an outer diameter within the range of 200 to 5,000 $\mu$m, and preferably within the range of 500 to 2,000 $\mu$m and a wall thickness within the range of 50 to 500 $\mu$m, and preferably within the range of 100 to 400 $\mu$m. The hollow fibers are assembled into a filter module before use for filtration. The filter module may be made up of a multiplicity of, for example, some tens to some hundred thousands, of the hollow fibers bundled together. Then, the bundled hollow fibers may be shaped into a generally U-shaped configuration, sealed their one ends collectively or independently with the use of any suitable sealing material, or left both ends open. The rinsing water is filtered by passing it under pressure through inside of the hollow fibers (an internal pressure system) or, alternatively, by passing it under pressure through outside the hollow fibers (an external pressure system), however, the external pressure system is preferred.

The activated carbon for substantially purifying the rinsing water may be in the form of activated coconut carbon particles, fibrous activated carbon material or any other suitable activated carbon material.

The hollow fiber membrane referred to above may be recycled upon removal of the foreign matter sticking to the hollow fibers by reverse-flushing it with liquid (either filtered water or purified water) or a gaseous medium (or a gaseous sterilized medium depending on application) under a preferred pressure of 0.5 to 3 Kg/cm$^2$, or by scrubbing the hollow fibers by a gaseous medium. During the reverse-flushing in which the liquid or the gaseous medium is allowed to flow through the hollow fibers in a direction counter to the direction of flow thereof during filtration, if the pressure of the gaseous medium is lower than the lowermost limit of the preferred pressure range, no satisfactory removal of the foreign matter from the hollow fibers be accomplished. On the other hand, if the pressure of the gaseous medium is higher than the uppermost limit of the preferred pressure range, not only would problems arise in connection with energy saving and the pressure resistance of the system, but also some or all of the hollow fibers may be damaged. Where the hollow fibers are oscillated to remove the foreign matter for recycling purpose, the gaseous medium under pressure of 0.2 to 0.5 Kg/cm$^2$ is preferably employed.

A representative example of the gaseous medium which can be used for recycling the hollow fiber membrane as discussed above may be air. The liquid to be reverse-flushed for recycling the hollow fiber membrane may be generally employed in the form of a purified water, but where the hollow fibers are considerably contaminated with the foreign matter, the use of an alkaline solution containing, for example, sodium hydroxide, or an acidic solution containing, for example, hydrochloric acid, sulfuric acid or the like may be employed therefor. In particular, where the alkaline solution heated to 50° to 90° C. is used, the hollow fibers can be cleaned extremely effectively.

Where the purified water is used for the reverse-flushing liquid, a drain removed by filtration through the micro-porous membrane can be solidified by a high water absorbent resin. The high water absorbent resin may be a commercially available resin such as, for example, that tradenamed "AquaKeep" and available from Sumitomo Seika Kabushiki Kaisha of Japan, which may be added in a quantity of 5 to 20 g per liter to the drain and stirred to securely solidify particles contained in the drain.

To facilitate drying of the articles after they have been rinsed, the rinsing water is preferably heated to 40° C., but not to a temperature higher than 80° C.

Preferably, the rinsing water is added with an anti-rust agent. Specifically, the anti-rust agent to be added to the rinsing water may be triethanol amine or monoethanol amine where the articles to be cleaned are made of iron, or sodium bichromate where the articles to be cleaned are made of zinc steel. The addition of the anti-rust agent is effective to avoid rusting which would otherwise occur after drying of the articles. Addition of a few ppm of triethanol amine or monoethanol amine or 1 to 2% of sodium bichromate is sufficient and effective to accomplish a satisfactory rust prevention.

According to the present invention, the articles to be cleaned are first immersed in the washing bath containing the detergent. By so doing, the oil-based contaminants can be removed from the articles. The oil-based contaminants so removed from the articles within the washing bath are emulsified by the action of the nonion surface active agent. However, where the amount of the oil-based contaminants is so large that the entire amount thereof cannot be emulsified and, hence, a portion of the oil-based contaminants is left within the washing bath without being emulsified by the surface active agent, residue oil components are then separated and float by the action of the terpene solvent contained in the detergent. The oil component afloat the water level within the washing bath can be removed by any suitable means, for example, by allowing them to be adsorbed by an adsorbent mat. After the washing, the articles to be cleaned are rinsed by the rinsing water within the rinsing bath in which the foreign matter carried over together with the articles from the washing bath can effectively washed off from the articles.

Thereafter, the foreign matter emulsified in the manner discussed above within the rinsing bath is allowed to flow, together with the rinsing water, through the recirculating passage. During this recirculation, the rinsing water containing the foreign matter flow through the precision filter including the microporous membrane having an average pore size within the range of 0.01 to 0.2 μm, to thereby separate and remove the foreign matter from the rinsing water. Components of the foreign matter which are dissolved into the rinsing water are removed by adsorption by the adsorbent filter containing a mass of the activated carbon, to provide a substantially purified water. The water so purified in the manner described above is returned to and used in the rinsing bath and, therefore, no waste water is produced.

The drain water containing foreign matter separated by the precision filter is recovered in a drain bath. Where the drain water are solidified in contact with the high water absorbent resin, the solidified drain water can be simply incinerated. The resultant ash content after incineration is small in quantity and non-hazardous.

BRIEF DESCRIPTION OF THE DRAWINGS

In any event, the present invention will become more clearly understood from the following description of a preferred embodiment thereof, when taken in conjunction with the accompanying drawings. However, the embodiment and the drawings are given only for the purpose of illustration and explanation, and are not to be taken as limiting the scope of the present invention in any way whatsoever, which scope is to be determined by the appended claims. In the accompanying drawings, like reference numerals are used to denote like parts throughout the several views, and:

DETAILED DESCRIPTION OF THE EMBODIMENT

Figure 1:
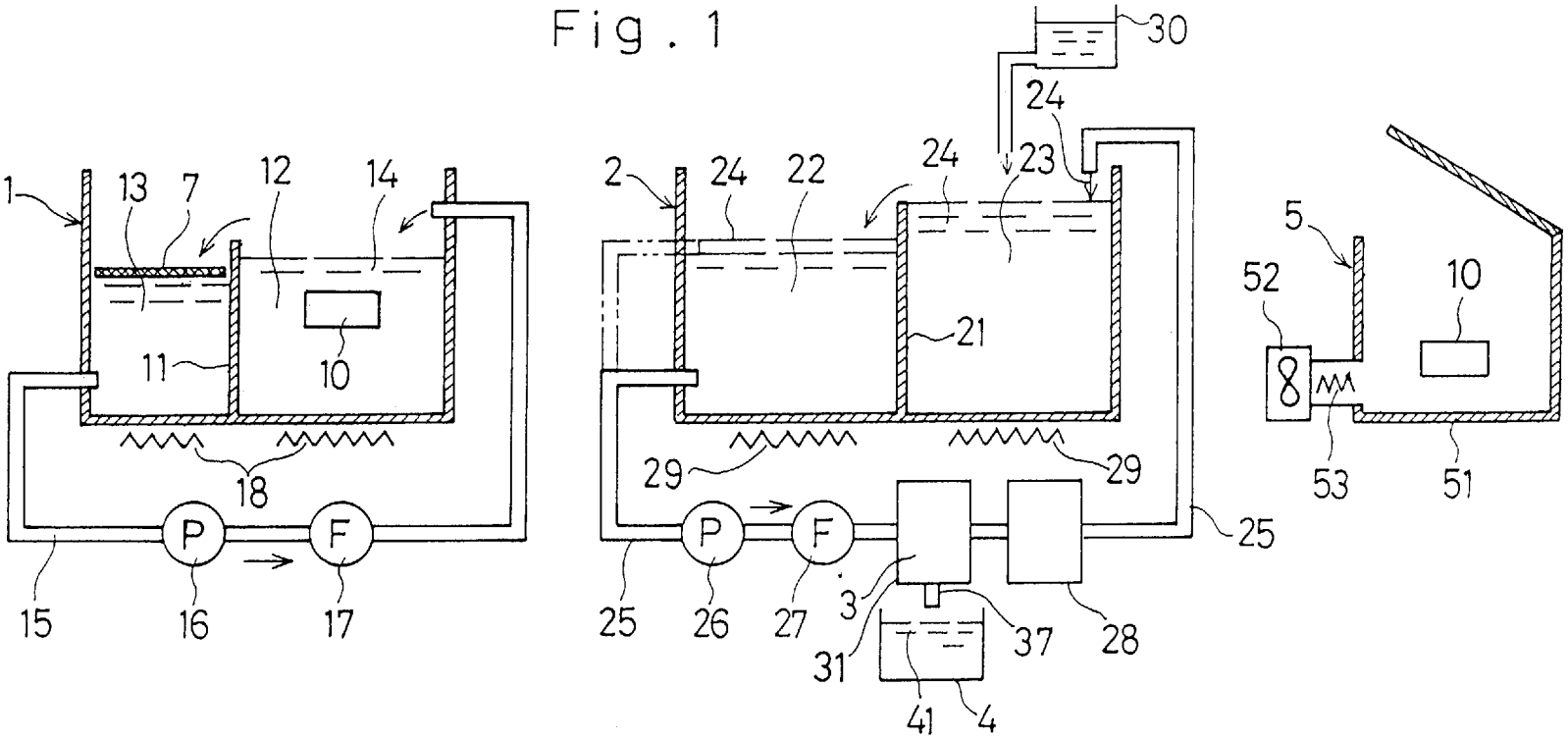
FIG. 1 is a schematic side sectional view showing a washing apparatus embodying the present invention.

Referring now to FIG. 1, a washing apparatus embodying the present invention comprises a washing bath 1 into which oil-contaminated articles 10 to be cleaned such as, for example, machine component parts are immersed, a rinsing bath 2 in which the articles 10 which have been washed in and removed from the washing bath 1 are rinsed, a precision filter 3 for filtering the rinsing water used in the rinsing bath 2 to separate and remove the foreign matter discussed hereinbefore, an adsorbent filter 28 containing a mass of activated carbon for removing by adsorption components contained in the filtrate having passed through the precision filter 3, and a drying unit 5 for drying the articles 10 having been cleaned.

The washing bath 1 includes a partition wall 11 dividing the interior thereof into a washing chamber 12 and a recovery chamber 13. A quantity of the detergent of the composition discussed hereinbefore, that is, the detergent 14 of a kind containing a nonion surface active agent and a terpene solvent as its principal components is contained in the washing chamber 12. The recovery chamber 13 can accommodate portion of the detergent 14 which has been flowed from the washing chamber 12 over the partition wall 11.

The washing chamber 12 and the recovery chamber 13 are communicated with each other through a recirculating passage 15 positioned outside the washing bath 1 and having its opposite ends fluid-connected respectively with the washing chamber 12 and the recovery chamber 13. Specifically, one of the opposite ends of the recirculating passage 15 which is in communication with the washing chamber 12 is positioned at a location above the water surface level within the washing chamber 12 whereas the other of the opposite ends of the recirculating passage 15 is in communication with the recovery chamber 13 at a location adjacent the bottom thereof.

The recirculating passage 15 which may be in the form of a piping includes a recirculating pump 16 and a filter 17 disposed thereon. The filter 17 includes a filtering medium of a kind having an average pore size within the range of 5 to 10 μm is operable to separate and remove SS (solid suspension) components which have been separated from the articles 10 within the washing chamber 12 and have been contained in the detergent 14 overflowing into the recovery chamber 13, before the detergent is recirculated to the washing chamber 12.

The washing bath 1 also includes heating elements 18 one for each of the washing and recovery chambers 12 and 13 for heating the detergents within those chambers 12 and 13, and an adsorbent mat 7 placed on a top liquid surface level within the recovery chamber 13 for adsorbing oil-based contaminants afloat the liquid surface level.

The rinsing bath 2 similarly includes a partition wall 21 dividing the interior thereof into a first rinsing chamber 22 for initially rinsing the articles 10 to be cleaned and a second rinsing chamber 23 for finally rinsing the articles 10 which have been initially rinsed within the first rinsing chamber 22. The second rinsing chamber 23 contains therein a quantity of clean rinsing water 24 consisting of water as a principal component thereof. On the other hand, the first rinsing chamber 22 accommodates the rinsing water 24 which has flowed from the second rinsing chamber 23 over the partition wall 21 and which has been used to rinse the articles 10. The first and second rinsing chambers 22 and 23 are communicated with each other through a recirculating passage 25 positioned outside the rinsing bath 2 and having its opposite ends fluid-connected respectively with the first and second rinsing chambers 22 and 23.

The recirculating passage 25 which may be in the form of a piping includes a recirculating pump 26 and a filter 27 similar in structure to the filter 17 disposed on the recirculating passage 15. Both of the precision filter 3 containing the micro-porous membrane and the adsorbent filter 28 containing a mass of activated carbon operable mainly to remove components of the solvent referred to hereinbefore are disposed on this recirculating passage 25 at a location downstream of the filter 27 with respect to the direction of recirculation of the rinsing water 24 from the first rinsing chamber 22 to the second rinsing chamber 23.

As is the case with the recirculating passage 15, a downstream end of the recirculating passage 25 is positioned at a location above the water surface level within the second rinsing chamber 23 so that the rinsing water 24 having passed through the precision filter 3 and then through the adsorbent filter 28 can be returned to the second rinsing chamber 23 through that downstream end of the recirculating passage 25 whereas an upstream end of the recirculating passage 25 opposite to the downstream end thereof is in communication with the rinsing chamber 22 at a location adjacent the bottom thereof. It is, however, to be noted that as shown by the phantom line in FIG. 1 the upstream end of the recirculating passage 25 may alternatively be communicated with the first rinsing chamber 22 at a location above or in the vicinity of the water surface level of the rinsing water 24 within the first rinsing chamber 22.

The rinsing bath 2 also includes heating elements 29 one for each of the first and second rinsing chambers 22 and 23 for heating the rinsing water 24 within those rinsing chambers 22 and 23 to a temperature within the range of 40° to 80° C. Positioned above the second rinsing chamber 23 is a reservoir 30 for accommodating a quantity of the anti-rust agent which is supplied dropwise into the second rinsing chamber 23. Also, an additional filter for filtering sands having an average pore size greater than the average pore size of 5 to 10 microns of the filter 27 may be disposed between the filter 27 and the pump 26.

Figure 2:
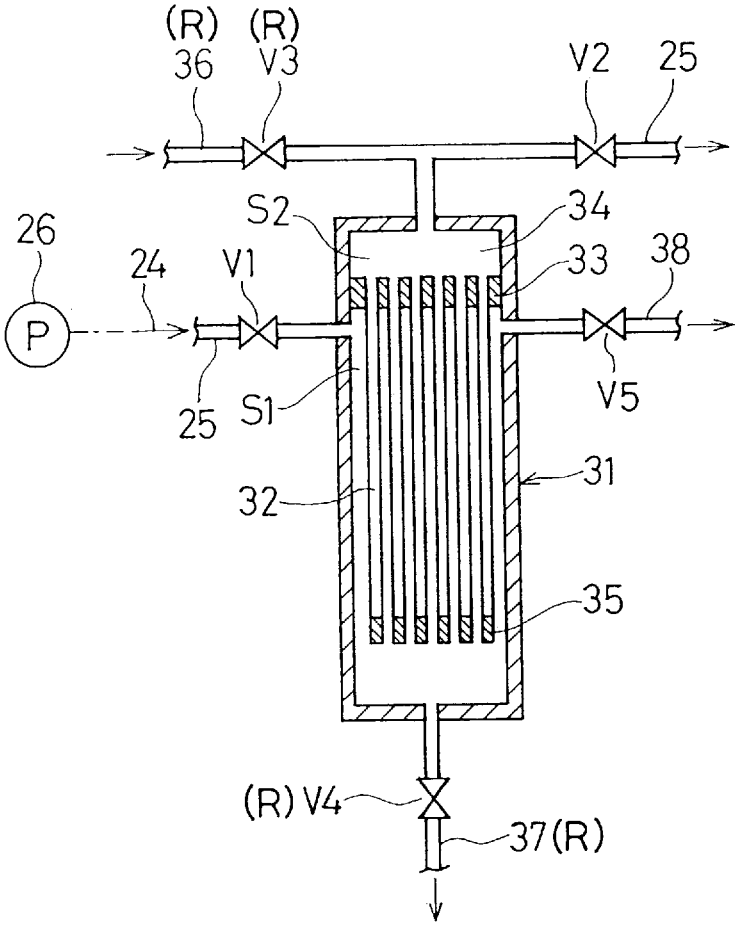
FIG. 2 is a longitudinal sectional view, on an enlarged scale, of a precision filter employed in the washing apparatus shown in FIG. 1.

Referring to FIG. 2, the precision filter 3 comprises a generally cylindrical filter column 31 and a multiplicity of hollow fibers forming the micro-porous membrane 32 inside of the filter column 31. The hollow fibers forming the micro-porous membrane 32 are open at their upper end and closed at their lower end independently by a sealing material 35. These hollow fibers are bundled together with their upper ends fixed in position inside the filter column 31 by means of a future 33 and communicated with a header 34 while the lower ends thereof are left unconstrained.

A portion of the recirculating passage 25 downstream of the recirculating pump 26 is fluid-coupled with a primary space S1 through an upper portion of a peripheral wall of the filter column 31 while a secondary space S2 forming the header 34 of the filter column 31 is fluid-coupled with another portion of the recirculating passage 25 upstream of the adsorbent filter 28. The header 34 is also communicated with a flushing passage 36 through which a flushing liquid or gas is supplied into the filter column 31. This flushing passage 36 may be in the form of a piping and is, in the illustrated embodiment, branched off from that portion of the recirculating passage 25 upstream of the adsorbent filter 28. The filter column 31 has a drain passage 37 extending from the bottom thereof for drainage of the filter column 31. The primary space S1 inside the filter column 31 is also communicated with an air vent passage 38 which may be in the form of a piping and which has one end opening into the primary space S1 at a location adjacent an upper region of the filter column 31.

That portion of the recirculating passage 25 communicated with the primary space S1 inside the filter column 31 is provided with a first ON/OFF valve V1; that portion of the recirculating passage 25 communicated with the secondary space S2 of the header 34 is provided with a second ON/OFF valve V2; the flushing passage 36 is provided with a third ON/OFF valve V3; the drain passage 37 is provided with a fourth ON/OFF valve V4; and the air vent passage 38 is provided with a fifth ON/OFF valve V5.

It is to be noted that the flushing passage 36, the third ON/OFF valve V3 disposed on the flushing passage 36, the drain passage 37 and the fourth ON/OFF valve V4 disposed on the drain passage 37 constitute a regenerating means R for the precision filter 3.

Referring back to FIG. 1, a drain container 4 is disposed below the filter column 31 for storing the drain discharged through the drain passage 37 and adapted to receive a quantity of the high water absorbent resin 41 from outside for solidifying the drain stored therein.

The drying unit S for drying the articles 10 after the latter have been rinsed comprises a drying chamber 51, a fan assembly 52 and a heater 53 and is so designed and so structured that air heated by the heater 53 can be blown by the fan assembly 52 into the drying chamber 51 to forcibly dry the articles 10 loaded into the drying chamber 51.

Hereinafter, a washing method practiced with the use of the washing apparatus of the structure described hereinbefore will now be described.

When the articles 10 to be cleaned which are oil-contaminated as shown in FIG. 1 are to be washed, the articles 10 are first immersed into the detergent 14 within the washing bath 1 to remove the oil-based contaminants therefrom. The oil-based contaminants removed from the articles 10 within the washing bath 1 are emulsified by the nonion surface active agent contained in the detergent 14. Should, however, the amount of the oil-based contaminants is so large that the entire amount thereof cannot be emulsified by the nonion surface active agent and, hence, a portion of the oil-based contaminants is left within the washing bath without being emulsified by the surface active agent, residue oil components are then separated and float by the action of the terpene solvent contained in the detergent. The residue oil-based contaminants are adsorbed by the adsorbent mat 7.

After the washing within the washing bath 1, the articles 10 are first immersed within the first rinsing chamber 22 and subsequently within the second rinsing chamber 23 to successively rinse the article with the rinsing water 24 to thereby remove the detergent which has been carried over from the washing bath 1 together with the articles 10.

In each of the first and second rinsing chambers 22 and 23, the rinsing water 24 is heated to a temperature within the range of 40° to 80° C. In particular, where the surface active agent of a kind having a clouding point within the temperature range of 40° to 80° C. is employed, the surface active agent will be coagulated and is therefore convenient for separation and removal by the precision filter. Also, the heating of the rinsing water 24 is effective to facilitate subsequent drying of the articles 10 within the drying chamber 51.

During the execution of the washing method, the recirculating pump 26 shown in FIG. 1 is to be driven while the first and second ON/OFF valves V1 and V2, all shown in FIG. 2, are opened and the third to fifth ON/OFF valves V3 to V5 are closed, so that the rinsing water 24 can be recirculated from the first rinsing chamber 22 to the second rinsing chamber 23 through the recirculating passage 25. As the rinsing water 24 flows through the filter 27, the SS components of a particle size of about 1 to 10 $\mu$m are removed and the previously discussed foreign matter admixed in the rinsing water 24 flows into the filter column 31 of the precision filter 3 together with the rinsing water 24. As the foreign matter flows through the precision filter 3, emulsions contained in the rinsing water 24 are mainly removed by filtration by the micro-porous membrane 32 disposed within the filter column 31. The filtrate (the rinsing water) 24 within the precision filter 3 is then discharged into the recirculating passage 25 through the header 34 at the top of the filter column 31 and is subsequently passed through the adsorbent filter 28. During the flow of the filtrate through the adsorbent filter 28, components dissolved in the filtrate are removed by adsorption and is then returned to the second rinsing chamber 23. Thus, the used rinsing water 24 can be reused with no waste produced. On the other hand, the foreign matter removed by the micro-porous membrane 32 sticks to surfaces of the hollow fibers forming the micro-porous membrane 32 and/or is trapped within the filter column 31.

When after a long period of use the hollow fibers forming the microporous membrane 32 get contaminated or a predetermined quantity of the foreign matter is trapped within the filter column 31, they can be cleaned. At this time, while the first and second ON/OFF valves V1 and V2 are closed and the third and fourth ON/OFF valves V3 and V4 are opened, a liquid or gaseous medium for reverse-flushing is injected through the flushing passage 36 into the hollows of the hollow fibers forming the micro-porous membrane 32, that is, into the hollow fibers forming the micro-porous membrane 32 through the header 34 of the filter column 31 or from an outlet side of filtrate. As the liquid or gaseous medium flows from inside to outside of the hollow fibers forming the micro-porous membrane 32, that is, from the secondary space S2 towards the primary space S1 or an inlet side of the rinsing water through the hollow fibers in a direction counter to the direction of flow of the rinsing water 24, the foreign matter sticking to the hollow fibers forming the micro-porous membrane 32 is removed. At the same time, the foreign matter trapped within the filter column 31 is also purged outwardly from the filter column 31. The foreign matter so removed by the action of the flushing liquid or gaseous medium in the manner described above is subsequently discharged as a drain to the drain container 4 through the drain passage 37. At this time, unlike the reverse flushing discussed above, the gaseous medium may be introduced from bottom into the filter column 31 to scrub the hollow fibers forming the micro-porous membrane 32 to remove the foreign matter sticking thereto.

Thereafter, when the high water absorbent resin 41 is introduced into the drain container 4 shown in FIG. 1, the drain within the drain container 4 can be solidified. Since this drain contains not only the oil components, but also the organic solvent, it can be simply disposed of by incineration. The articles 10 having been rinsed with the rinsing water are subsequently dried by the drying unit 5.

Results of comparative tests conducted to evaluate the present invention will now be demonstrated.

EXAMPLE 1

The detergent, identified by A, was prepared which comprises a solution of 10 vol % of the commercially available detergent, "KZ-4000" (available from Kabushild Kaisha Kinzoku Kako Gijutsu Kenkyusho), of the kind containing the nonion surface active agent and the terpene solvent.

Comparison 1

The detergent, identified by B, was prepared which contain 1 wt % of the nonion surface active agent that is a representative detergent.

In each of Example 1 and Comparison 1, the hollow fibers forming the micro-porous membrane 32 for the precision filter 3 used were of a type made of polyvinyl alcohol resin and having an average pore size of 0.2 $\mu$m.

During the experiments in which the detergents A and B were employed separately, the detergent within the washing bath 1 was recirculated by driving the recirculating pump 16 shown in FIG. 1 and associated with the washing bath 1. At the same time, the rinsing water within the rinsing bath 2 was also recirculated through the micro-porous membrane 32 by driving the recirculating pump 26 associated with the rinsing bath 2. While in this condition, the oil-contaminated articles 10 were washed in the washing bath 1 and is then rinsed in the rinsing bath 2.

As a result, when the detergent B was used, the liquid medium having passed through the hollow fibers forming the micro-porous membrane 32 was found somewhat clouded, whereas when the detergent A was used, the liquid medium having passed through the hollow fibers forming the micro-porous membrane 32 was found crystal clear. It has also been found that even when the liquid medium containing the detergent A and having passed through the hollow fibers forming the micro-porous membrane 32 was heated to 40° C., no clouding occurred. Accordingly, it can readily be understood that in the case where the detergent A was used, the foreign matter was securely separated and removed from the rinsing water.

To demonstrate the foregoing results of the experiments, the results of the comparative tests are tabulated in Tables 1 and 2 below. Table 1 is associated with the use of the detergent A and Table 2 is associated with the use of the detergent B.

TABLE 1

(Detergent A Used)

| | Upstream of Membrane 32 | Downstream of Membrane 32 (25° C.) | Downstream of Membrane 32 (40° C.) | Downstream of Filter 28 |
|---|---|---|---|---|
| BOD Value | 150 mg/l | 16 mg/l | 15 mg/l | 5 mg/l |
| COD Value | 320 mg/l | 53 mg/l | 50 mg/l | 10 mg/l |
| Extract of Normal Hexane | 100 mg/l | 10 mg/l | 8 mg/l | >1.0 mg/l |

TABLE 2

(Detergent B Used)

| | Upstream of Membrane 32 | Downstream of Membrane 32 (25° C.) | Downstream of Membrane 32 (40° C.) | Downstream of Filter 28 |
|---|---|---|---|---|
| BOD Value | 200 mg/l | 110 mg/l | 100 mg/l | 16 mg/l |
| COD Value | 345 mg/l | 290 mg/l | 220 mg/l | 32 mg/l |
| Extract of Normal Hexane | 150 mg/l | 90 mg/l | 80 mg/l | >1.0 mg/l |

It appears that the reason that the detergent A has an excellent capability of removing the foreign matter is because the detergent KZ-4000 containing the nonion surface active agent and the terpene solvent as its principal component has a high emulsifying capability and, also, because the terpene solvent contained in the detergent A has such an action to cause excessive oil-based contaminants (excessive oil-based contaminants left without being emulsified) to float that excessive oil-based contaminants cannot flow into the recirculating passage 25. The excessive oil-based contaminants floating on the surface level within the washing bath 1 can easily be removed by adsorption by any suitable adsorbent means such as the adsorbent mat.

Also, when the drain separated and removed from the hollow fibers, forming the micro-porous membrane 32, during the reverse-flushing and subsequently discharged into the drain container 4 is added and stirred with the commercially available high water absorbent resin, "AquaKeep", in a quantity of 20 g per liter of the drain, the drain can be solidified in 2 to 3 minutes. When this solidified drain is incinerated, 20 liters of the solidified drain is transformed into 100 milliliter of ash component.

EXAMPLE 2

The rinsing bath 2 containing the detergent A used in Example 1 was added with 3 ppm of triethanol amine as an anti-rust agent. While the rinsing bath 2 contained the anti-rust agent, machine component parts made of pure iron were washed, rinsed and dried. No rust was found on surfaces of the machine component parts after drying.

Comparison 2

Without adding the triethanol amine to the rinsing bath 2 containing the detergent A used in Example 1, machine component parts made of pure iron were washed, rinsed and dried. A trace of rust was found on surfaces of the machine component parts after drying.

As hereinbefore fully described, according to the washing method and the washing apparatus of the present invention, the rinsing water can be repeatedly and continuously used without being drained outside the system as a waste water, while the rinsing water maintains a satisfactory rinsing action. Addition of the anti-rust agent to the rinsing water is effective to avoid rusting of metallic component parts.

Although the present invention has been fully described in connection with the preferred embodiments thereof with reference to the accompanying drawings which are used only for the purpose of illustration, those skilled in the art will readily conceive numerous changes and modifications within the framework of obviousness upon the reading of the specification herein presented of the present invention. Accordingly, such changes and modifications are, unless they depart from the scope of the present invention as delivered from the claims annexed hereto, to be construed as included therein.

What is claimed is:

1. A method for washing articles, comprising:

washing an article in a detergent comprising a non-ionic surface active agent and a terpene-based solvent;

rinsing said article in a rinse bath with liquid rinse water;

draining said liquid rinse water from said rinse bath;

filtering said liquid rinse water; and returning said liquid rinse water to said rinse bath, wherein filtration of said liquid rinse water comprises a first stage and a second stage, said first stage comprising filtering said liquid rinse water through a microporous filter with an average pore size of 0.01–0.2 microns, and said second stage comprising filtering said liquid rinse water through activated carbon, wherein said microporous filter separates and removes colloidal micelles from said liquid rinse water.

2. The method for washing articles as claimed in claim 1, further comprising:

solidifying waste with a water absorbent resin, said waste produced by filtering said liquid rinse water.

3. The method for washing articles as claimed in claim 1, wherein said microporous membrane comprises a multiplicity of hollow fibers and wherein the hollow fibers used for filtration are regenerated by flowing a liquid or gaseous medium in a direction from an outlet side of filtrate towards an inlet side of the liquid rinse water.

4. The method for washing articles as claimed in claim 1, further comprising a step of adding an anti-rust agent to the liquid rinse water.

* * * * *

UNITED STATES PATENT AND TRADEMARK OFFICE

CERTIFICATE OF CORRECTION

PATENT NO. : 5,851,305

DATED : December 22, 1998

INVENTOR(S): Yousuke YAMADA, et al.

It is certified that an error appears in the above-identified patent and that said Letters Patent is hereby corrected as shown below:

On the title page, in Item [73], the second assignee's name should read:

--Kinzoku Kako Gijutsu Kenkyusho Co., Ltd.--

Signed and Sealed this

Twenty-first Day of September, 1999

*Attest:*

Q. TODD DICKINSON

*Attesting Officer*

*Acting Commissioner of Patents and Trademarks*